US012405080B1

(12) United States Patent
Duecker

(10) Patent No.: US 12,405,080 B1
(45) Date of Patent: Sep. 2, 2025

(54) METHOD AND SYSTEM FOR DETERMINING A PREFERRED LOCATION FOR A PEEP SIGHT ON A COMPOUND BOW

(71) Applicant: Pyramyd Air Ltd., Solon, OH (US)

(72) Inventor: Ronald William Duecker, Barberton, OH (US)

(73) Assignee: Pyramyd Air Ltd., Solon, OH (US)

( * ) Notice: Subject to any disclaimer, the term of this patent is extended or adjusted under 35 U.S.C. 154(b) by 0 days.

(21) Appl. No.: 19/202,566

(22) Filed: May 8, 2025

Related U.S. Application Data

(60) Provisional application No. 63/647,821, filed on May 15, 2024.

(51) Int. Cl.
*F41B 5/14* (2006.01)
*F41G 1/467* (2006.01)

(52) U.S. Cl.
CPC ..... *F41B 5/148* (2013.01); *F41B 5/1419* (2013.01)

(58) Field of Classification Search
CPC ..... F41B 5/14; F41B 5/1403; F41B 5/1419; F41B 5/148; F41G 1/467; F41G 1/54; F41G 1/545; G01B 5/0023
USPC ..... 124/1, 87, 90, 91; 33/265
See application file for complete search history.

(56) References Cited

U.S. PATENT DOCUMENTS 3,600,814 A * 8/1971 Smith ..... F41H 5/14 33/506
3,651,578 A * 3/1972 Saunders ..... F41H 5/14 33/286
3,969,825 A * 7/1976 Mathes ..... F41H 5/14 124/90
4,382,339 A * 5/1983 Saunders ..... G01B 5/0023 33/506
4,594,786 A * 6/1986 Rezmer ..... G01B 5/0023 33/506
4,911,137 A * 3/1990 Troncoso ..... F41B 5/14 33/506
4,974,576 A * 12/1990 Morey ..... F41B 5/14 248/688
5,060,627 A * 10/1991 Fenchel ..... F41B 5/1438 124/90
5,175,937 A * 1/1993 Emerson, III ..... F41B 5/14 33/503
5,201,304 A * 4/1993 Rezmer ..... F41B 5/14 124/24.1
5,231,971 A * 8/1993 York ..... F41B 5/14 124/90

(Continued)

OTHER PUBLICATIONS

United States Patent and Trademark Office, International Search Report and Written Opinion issued in corresponding Application No. PCT/US2025/028341 mailed Jul. 9, 2025.

(Continued)

*Primary Examiner* — Alexander R Niconovich
(74) *Attorney, Agent, or Firm* — Stites & Harbison, PLLC; David W. Nagle, Jr.

(57) ABSTRACT

In a method and system for determining a preferred location for a peep sight on a compound bow, an eye height measurement is requested from or otherwise obtained from a user, and measurements of the compound bow are requested or retrieved. From such measurements, a preferred location for a peep sight can be determined.

13 Claims, 5 Drawing Sheets

(56) References Cited

U.S. PATENT DOCUMENTS

| | | | | | |
|---|---|---|---|---|---|
| 5,351,407 | A * | 10/1994 | Van Drielen | F41B 5/14 | 33/506 |
| 5,353,511 | A * | 10/1994 | Boll | F41B 5/14 | 33/506 |
| 5,983,879 | A * | 11/1999 | Gifford | F41B 5/1449 | 33/506 |
| 6,024,079 | A * | 2/2000 | Ingle | F41G 1/467 | 124/90 |
| 6,526,666 | B1 * | 3/2003 | Lastinger, Jr. | F41B 5/143 | 124/87 |
| 7,353,611 | B2 * | 4/2008 | Edwards | F41G 1/545 | 124/87 |
| 7,543,389 | B2 * | 6/2009 | Grace, Jr. | F41B 5/1419 | 124/87 |
| 8,201,339 | B1 * | 6/2012 | Walker | F41G 1/467 | 124/87 |
| 9,448,036 | B2 * | 9/2016 | Samuels | F41G 1/473 | |
| 9,593,904 | B2 * | 3/2017 | Naki | F41B 5/148 | |
| 9,829,278 | B2 * | 11/2017 | Wolf | F41B 5/1419 | |
| 10,101,123 | B2 * | 10/2018 | Wolf | F41B 5/1419 | |
| 11,306,993 | B2 * | 4/2022 | Bushman | G01P 3/685 | |
| 2005/0193998 | A1 * | 9/2005 | Cooper | F41B 5/105 | 124/25.6 |
| 2009/0165767 | A1 * | 7/2009 | Parrish | F41B 5/14 | 124/90 |
| 2014/0176463 | A1 * | 6/2014 | Donahoe | F41B 5/148 | 345/173 |
| 2014/0190460 | A1 * | 7/2014 | Langley | F41B 5/105 | 124/25.6 |
| 2015/0040409 | A1 * | 2/2015 | Morrison | F41G 1/35 | 33/228 |
| 2019/0011224 | A1 * | 1/2019 | Ahlgren | F41G 1/545 | |
| 2021/0262760 | A1 * | 8/2021 | VanCamp | F41G 3/323 | |

OTHER PUBLICATIONS

Bowhunter TV, "Dead On: How to Find the Correct D-Loop Length." 2018. Retrieved on Jun. 25, 2025 from <https://www.youtube.com/watch?v=iJMWcQ5LoU8&t=1s>.

Lau, M., et al. "A device for measuring the variable lateral bow angle and its impact on score loss." Proceedings of the Institution of Mechanical Engineers, Part P: Journal of Sports Engineering and Technology 233.3 (2019): 362-369. Retrieved on Jun. 25, 2025 from <https://research.monash.edu/en/publications/a-device-for-measuring-the-variable-latera••bow-angle-and-its-imp>.

* cited by examiner

METHOD AND SYSTEM FOR DETERMINING A PREFERRED LOCATION FOR A PEEP SIGHT ON A COMPOUND BOW

CROSS-REFERENCE TO RELATED APPLICATION

The present application claims priority to U.S. Patent Application Ser. No. 63/647,821 filed on May 15, 2024, the entire disclosure of which is incorporated herein by reference.

BACKGROUND OF THE INVENTION

In archery, a compound bow includes a cam (or pulley) system that increases mechanical advantage. One of the earliest compound bows is described and claimed in U.S. Pat. No. 3,486,495, which is entitled "Archery bow with draw force multiplying attachments" and is incorporated herein by reference. Although compound bows have evolved over the years, they still include a few core components. FIG. 1 is a schematic view of compound bow 10 that illustrates these core components: a central riser 20, which serves as the central mounting point for other components, including a grip that that is grasped by the user; upper and lower limbs 30, 40 that are flexible and store the kinetic energy of the bow 10; a cam (or wheel) 35, 45 at the distal end of each limb 30, 40; and a bowstring 50. Furthermore, a compound bow ordinarily includes a D-loop 55, which is a length of cord tied or otherwise secured to the bowstring 50, which the user uses to draw the bowstring 50.

In using a compound bow, a peep sight is often mounted to the bowstring 50. A peep sight (not shown) is secured to the bowstring 50 and defines an aperture through which the archer looks in aiming the bow. Specifically, the archer looks through the aperture and aligns the view through the peep sight with the sight pins (not shown) mounted to the riser 20. Such use of a peep sight is well-known in the art. To function properly, however, the peep sight needs to be secured to the bowstring 50 at a height that works for the archer.

It is common for peep sights to be installed via a custom fitting and/or via trial and error, which is time-consuming and inefficient.

Thus, there is a need for a more efficient method and system for determining a preferred location for a peep sight on a compound bow.

SUMMARY OF THE INVENTION

The present invention is a method and system for determining a preferred location for a peep sight on a compound bow. In the method and system of the present invention, by requesting or otherwise obtaining an eye height measurement from a user, and then requesting or retrieving measurements of the compound bow, a preferred location for a peep sight can be determined.

An exemplary system for determining a preferred location for a peep sight on a compound bow made in accordance with the present invention includes a computer with a processor, a memory component, and a user interface. The processor of the computer is programmed to execute instructions stored in the memory component to carry out each of the operational and computational steps.

An exemplary method for determining a preferred location for a peep sight on a compound bow in accordance with the present invention includes steps of: (i) prompting a user, via the user interface, and according to instructions programmed into and executed by the processor, to input an eye height measurement (or certain anatomical measurements or information which may be correlated to eye height); (ii) receiving, via the user interface, the eye height measurement (of the anatomical measurements or information which may be correlated to eye height); (iii) prompting the user, via the user interface, and according to instructions programmed into and executed by the processor, to input an identification of the compound bow (or certain measurements of the bow); (iv) receiving, via the user interface, the identification of the compound bow (or certain measurements of the bow); (v) using the processor, according to instructions programmed into and executed by the processor, to retrieve (a) a cam-to-arrow distance and (b) a right-to-D-loop distance from a database based on the identification of (or certain measurements of) the compound bow; and (vi) using the processor, according to instructions programmed into and executed by the processor, to calculate the preferred location for the peep sight based on the eye height measurement, the cam-to-arrow distance of the compound bow, and the right-to-D-loop distance of the compound bow.

With respect to such calculations, a vertical reference line extends from (i) a first point of contact between an upper cam and a bowstring of the compound bow, and (ii) a second point of contact between a lower cam and the bowstring of the compound bow, when the compound bow is in a drawn position. A horizontal reference line is representative of an arrow in the compound bow in the drawn position. The cam-to-arrow distance is a measurement of a vertical distance between (i) the first point of contact and (ii) the horizontal reference line. The right-to-D-loop distance is a measurement of a horizontal distance between (i) an intersection of the vertical reference line and the horizontal reference line and (ii) a D-loop of the bowstring in the drawn position.

DESCRIPTION OF THE INVENTION

The present invention is a method and system for determining a preferred location for a peep sight on a compound bow. In the method and system of the present invention, by requesting or otherwise obtaining an eye height measurement from a user, and then requesting or retrieving measurements of the compound bow, a preferred location for a peep sight can be determined.

Figure 1:
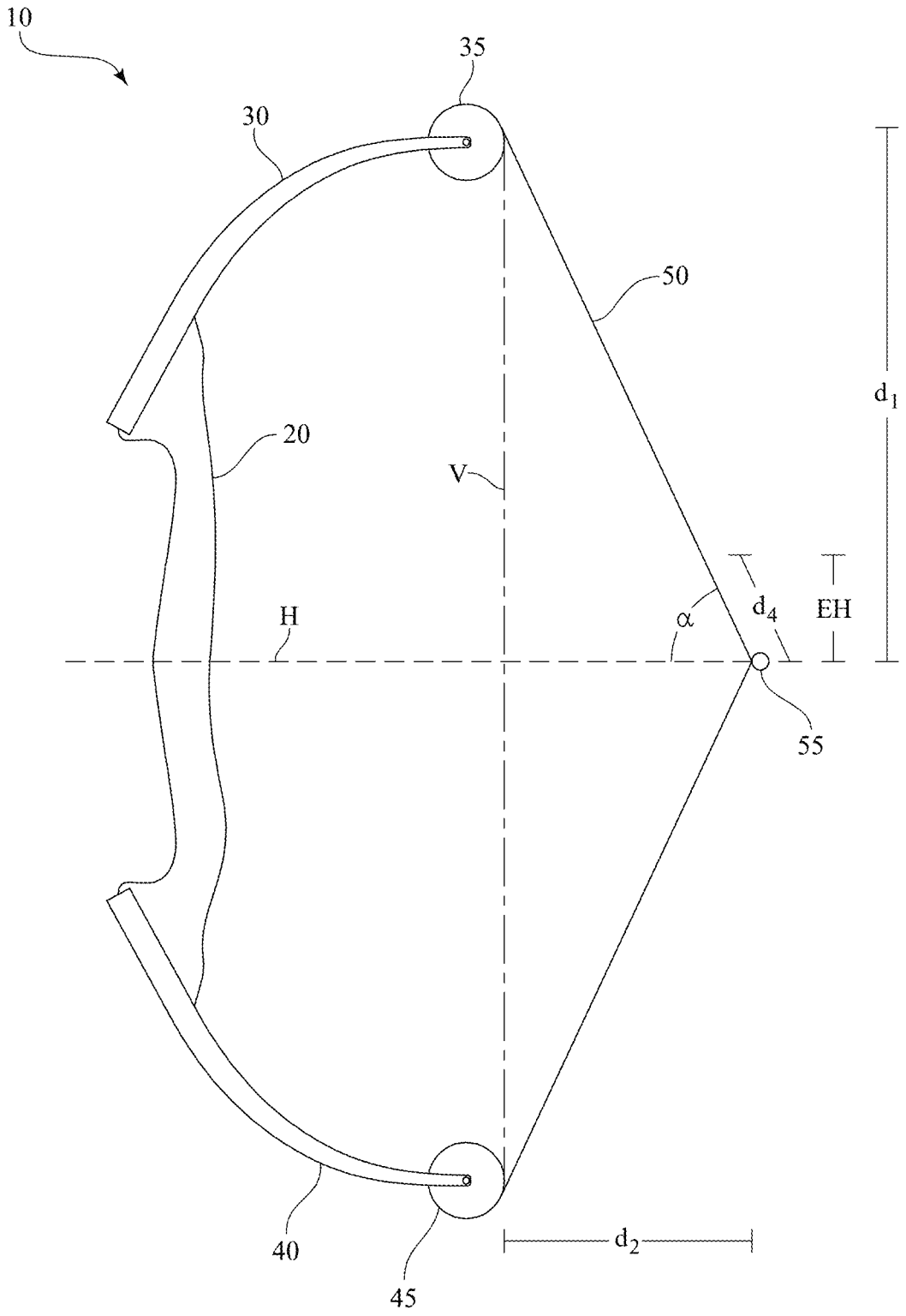
FIG. 1 is a schematic view of a compound bow.

Referring again to FIG. 1, in this schematic view, the bowstring 50 is drawn. In FIG. 1, a vertical reference line, V, extends from (i) a first point of contact between the upper cam 35 and the bowstring 50 of the compound bow 10 and (ii) a second point of contact between the lower cam 45 and the bowstring 50 of the compound bow 10. Furthermore, in FIG. 1, a horizontal reference line, H, is representative of an arrow in the compound bow 10.

Referring still to FIG. 1, a cam-to-arrow distance, $d_1$, is a measurement of a vertical distance between (i) the first point of contact and (ii) the horizontal reference line, H.

Referring still to FIG. 1, a right-to-D-loop distance, $d_2$, is a measurement of a horizontal distance between (i) an intersection of the vertical reference line, V, and the horizontal reference line, H, and (ii) the D-loop 55 on the bowstring 50.

Figure 3:
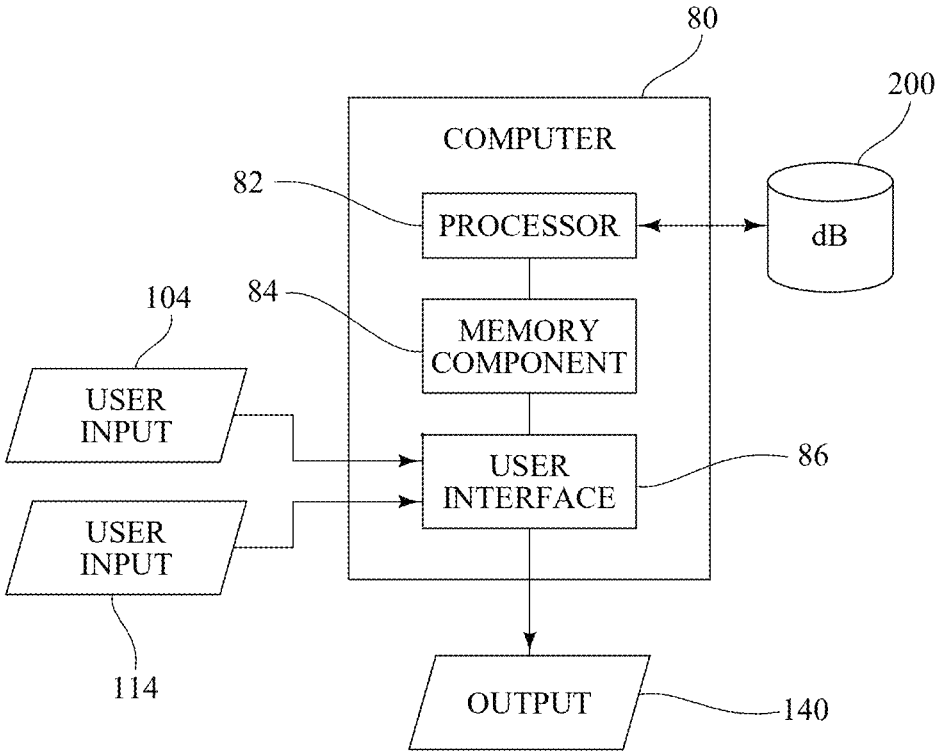
FIG. 3 is a schematic view of an exemplary system for determining a preferred location for a peep sight on a compound bow made in accordance with the present invention.

Referring now to FIG. 3, an exemplary system for determining a preferred location for a peep sight on a compound bow made in accordance with the present invention includes a computer 80 with a processor 82, a memory component 84, and a user interface 86. The processor 82 of the computer 80 is programmed to execute instructions stored in the memory component 84 to carry out each of the below-described operational and computational steps.

Figure 4:
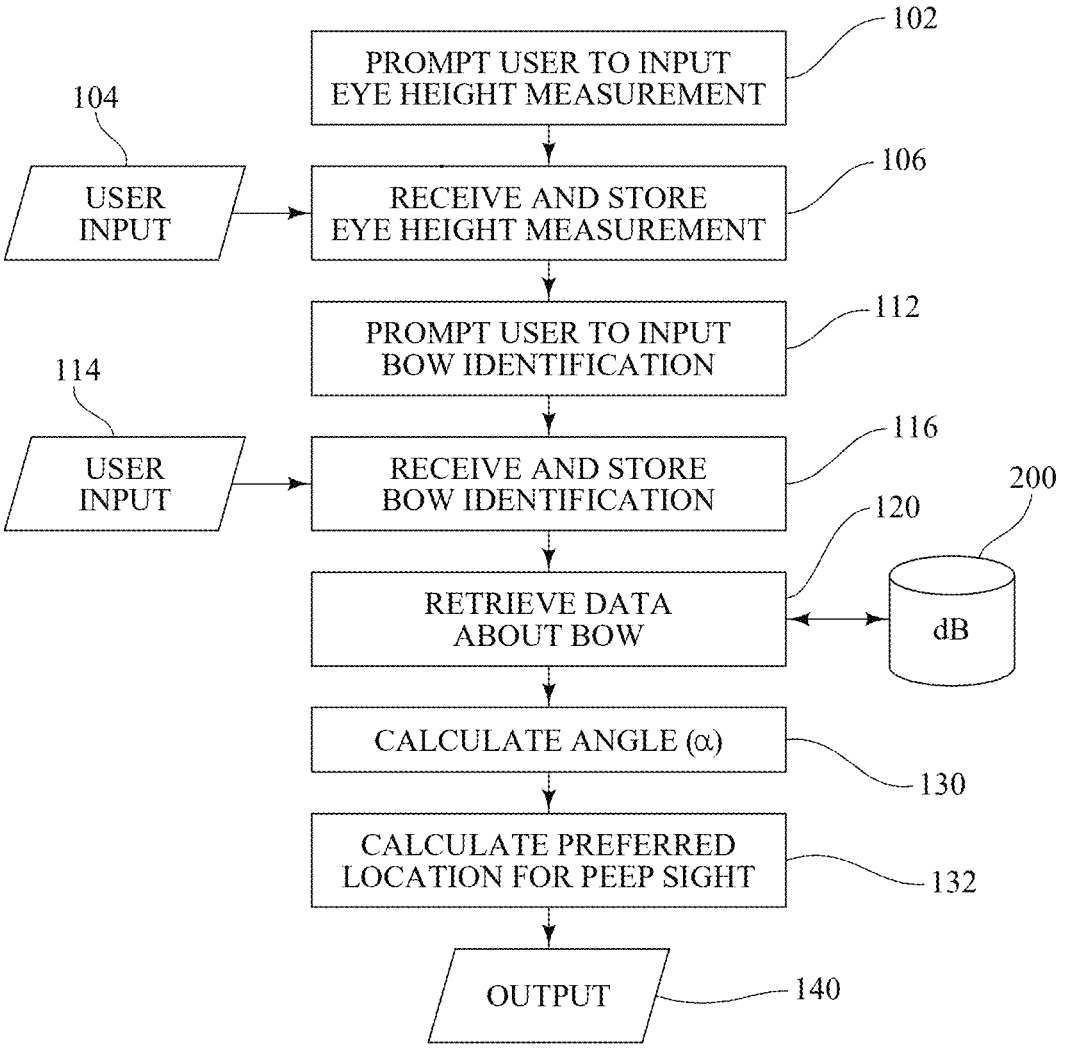
FIG. 4 illustrates an exemplary method for determining a preferred location for a peep sight on a compound bow in accordance with the present invention.

Referring now to FIG. 4, as a first step in an exemplary method of the present invention, certain inputs are requested and received from a user. The user may be a customer, (e.g., an individual purchasing a bow via a web site or ecommerce platform), or the user may be a third party, such as a retail store employee assisting a customer in the selection and purchase of a bow, whether in-person or remotely (e.g., via phone).

Figure 5:
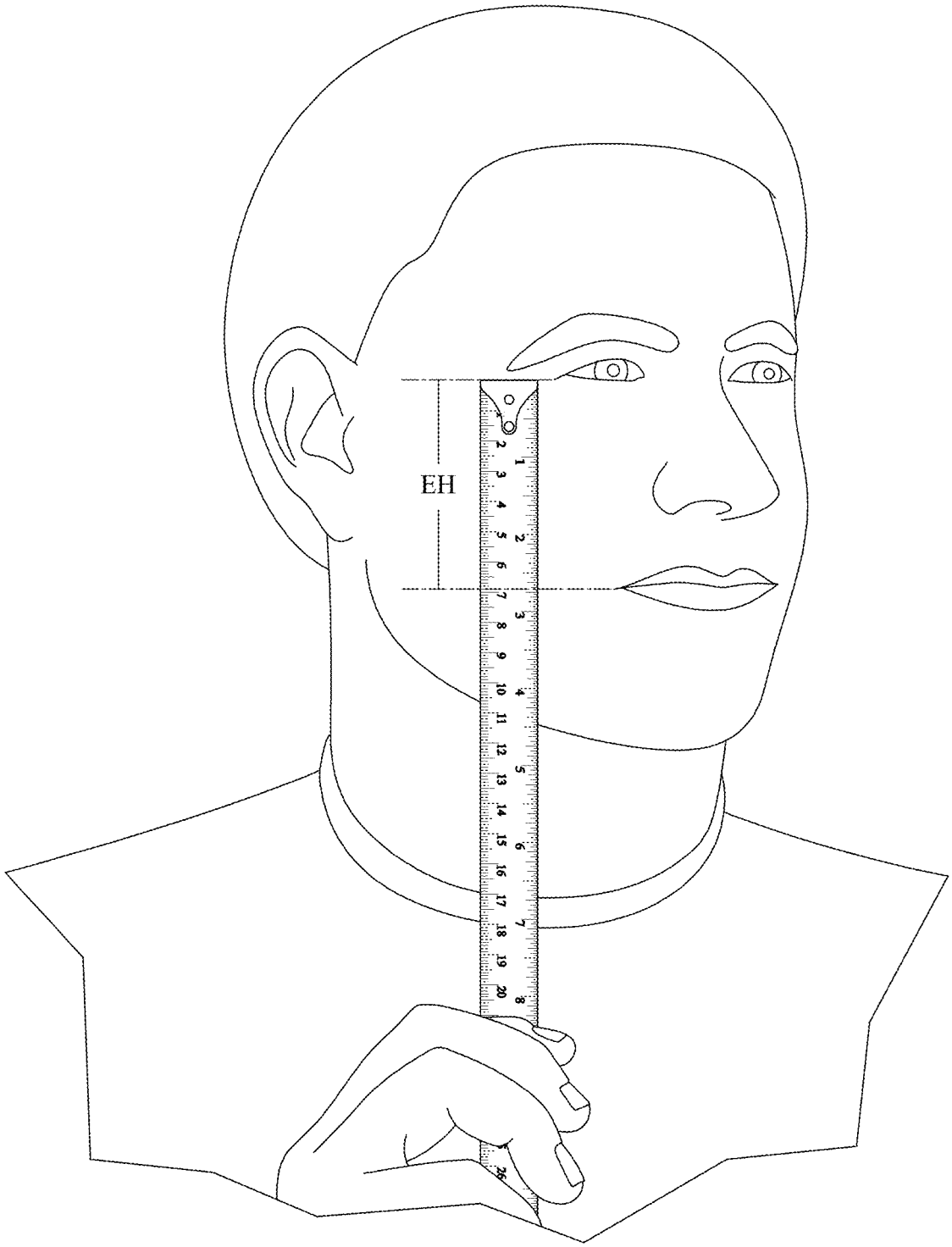
FIG. 5 illustrates the eye height measurement, EH.

Specifically, the user is prompted via a user interface 86 (FIG. 3), such as a web page, according to instructions programmed into and executed by the processor 82 (FIG. 3), to input an eye height measurement, as indicated by block 102 in FIG. 4. In this regard, instructions may be provided via the user interface 86 (FIG. 3) to facilitate such measurement by the user. For example, the user may be provided with an image similar to that shown in FIG. 5, illustrating that the eye height measurement should be the vertical distance from (i) the corner of the eye to the (ii) corner of the mouth, with the user looking directly ahead with his head in an upright position.

Once received, as indicated by input 104, the eye height measurement, EH, is stored for subsequent use as indicated by block 106. For example, the eye height measurement, EH, may be stored in the memory component 84 (FIG. 3).

In alternative implementations, rather than or in addition to prompting the user to input an eye height measurement, EH, the user may be prompted to enter certain anatomical measurements or information, which may be correlated to eye height. In such alternative implementations, the eye height measurement, EH, is then derived from or confirmed by the other anatomical measurements or information.

Referring still to FIG. 4, the user is also prompted via the user interface 86 (FIG. 3), according to instructions programmed into and executed by the processor 82 (FIG. 3), to input an identification of the compound bow, as indicated by block 112 in FIG. 4. This may be achieved, for example, by providing the user with a pull-down menu or similar option for selecting from a list of known compound bows and draw lengths. For an optimal determination of the preferred location for the peep sight, the draw length must be considered, as should become apparent in the calculations that follow.

Once received, as indicated by input 114, the identification of the compound bow (including draw length) is stored for subsequent use, as indicated by block 116. For example, the identification of the compound bow may also be stored in the memory component 84 (FIG. 3).

Referring still to FIG. 4, based on the identification of the compound bow (including draw length), data about the compound bow is retrieved from a database 200, according to instructions programmed into and executed by the processor 82 (FIG. 3), as indicated by block 120. Specifically, based on the identification of the bow, the cam-to-arrow distance and the right-to-D-loop distance (as described above) are retrieved from the database 200.

In alternative implementations, rather than prompting the user to input an identification of the compound bow, the user may be prompted to enter certain measurements of the bow, such as the cam-to-arrow distance and the right-to-D-loop distance. In other words, in such alternative implementations, the cam-to-arrow distance and the right-to-D-loop distance are received as inputs, or are otherwise derived from inputs, rather than retrieved from a database.

Referring still to FIG. 4, the next step is to calculate an angle, α, between the horizontal reference line, H, and a line formed by a bowstring of the compound bow that extends from the upper cam 35 to the D-loop 55, as indicated by block 130 in FIG. 4:

$$\alpha=\arctan(d_1/d_2) \tag{1}$$

Such calculation is carried out using the processor 82 of the computer 80, according to instructions programmed into and executed by the processor 82.

Referring again to FIG. 4, the next step is to calculate a preferred location for the peep sight relative to the D-loop, $d_4$, based on the calculated angle and the eye height measurement, as indicated by block 132 in FIG. 3:

$$d_4=EH/\sin(\alpha) \tag{2}$$

Such calculation is carried out using the processor 82 of the computer 80, according to instructions programmed into and executed by the processor 82.

Figure 2A:
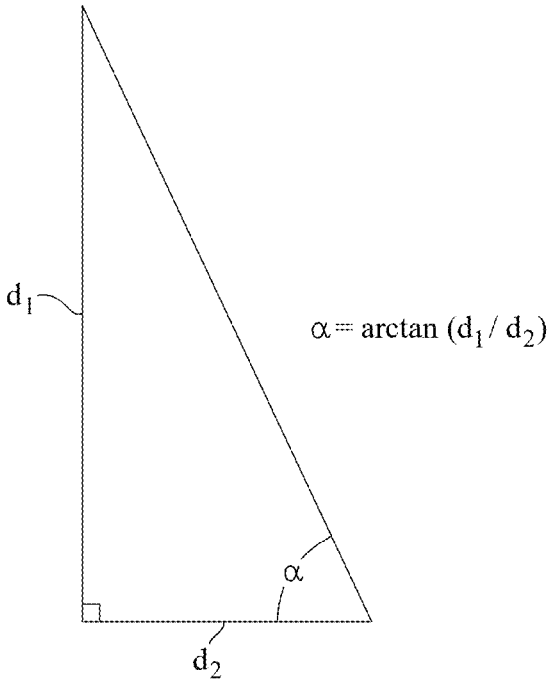
FIG. 2A further illustrates the relationships between the measurements $d_1$, $d_2$, and $\alpha$ of the compound bow of FIG. 1.
Figure 2B:
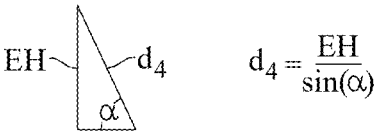
FIG. 2B further illustrates the relationships between the measurements $\alpha$, EH, and $d_4$ of the compound bow of FIG. 1.

FIG. 2A and FIG. 2B further illustrate the relationships between $d_1$, $d_2$, α, EH, and $d_4$.

Once the preferred location for the peep sight has been calculated, that information is displayed to and/or otherwise provided to the user, for example, via the user interface 86 (FIG. 3), as indicated by output 140 in FIG. 4.

As should be clear from the above description, the method and system of the present invention could be readily incorporated into an ordering process. Specifically, once a user selects a compound bow for purchase (for example, via a web site or ecommerce platform, or in another retail setting), and the preferred location for the peep sight has been calculated, that information can be displayed to and/or otherwise provided to the retailer, which can then install the peep sight before delivering the bow to the user.

One of ordinary skill in the art will recognize that additional embodiments and implementations are also possible without departing from the teachings of the present invention or the scope of the claims which follow. This description, and particularly the specific details of the exemplary embodiments and implementations disclosed, is given primarily for clarity of understanding, and no unnecessary limitations are to be understood therefrom, for modifications will become obvious to those skilled in the art upon reading this disclosure and may be made without departing from the spirit or scope of the claimed invention.

The invention claimed is:

1. A method for determining a preferred location for a peep sight on a compound bow, comprising steps of:

providing a processor programmed to execute instructions stored in a memory component;

providing a user interface in communication with the processor;

prompting a user, via the user interface, and according to instructions programmed into and executed by the processor, to input an eye height measurement;

receiving, via the user interface, the eye height measurement;

prompting the user, via the user interface, and according to instructions programmed into and executed by the processor, to input an identification of the compound bow;

receiving, via the user interface, the identification of the compound bow;

using the processor, according to instructions programmed into and executed by the processor, to retrieve (a) a cam-to-arrow distance and (b) a right-to-D-loop distance from a database based on the identification of the compound bow; and using the processor, according to instructions programmed into and executed by the processor, to calculate the preferred location for the peep sight based on the eye height measurement, the cam-to-arrow distance of the compound bow, and the right-to-D-loop distance of the compound bow;

wherein a vertical reference line extends from (i) a first point of contact between an upper cam and a bowstring of the compound bow, and (ii) a second point of contact between a lower cam and the bowstring of the compound bow, when the compound bow is in a drawn position;

wherein a horizontal reference line is representative of an arrow in the compound bow in the drawn position;

wherein the cam-to-arrow distance is a measurement of a vertical distance between (i) the first point of contact and (ii) the horizontal reference line; and wherein the right-to-D-loop distance is a measurement of a horizontal distance between (i) an intersection of the vertical reference line and the horizontal reference line and (ii) a D-loop of the bowstring in the drawn position.

2. The method as recited in claim 1, wherein the user interface is accessible via a web page.

3. The method as recited in claim 1, wherein as part of the step of prompting the user to input the eye height measurement, instructions are provided via the user interface to facilitate such measurement by the user.

4. The method as recited in claim 1, wherein as part of the step of prompting the user to input the identification of the compound bow, a list of known compound bows is provided to the user.

5. The method as recited in claim 1, wherein the step of using the processor to calculate the preferred location for the peep sight includes substeps of:

calculating an angle between the horizontal reference line and a line formed by the bowstring of the compound bow that extends from the upper cam to the D-loop; and calculating the preferred location for the peep sight relative to the D-loop based on the calculated angle and the eye height measurement.

6. A method for determining a preferred location for a peep sight on a compound bow, comprising steps of:

providing a processor programmed to execute instructions stored in a memory component;

providing a user interface in communication with the processor;

prompting a user, via the user interface, and according to instructions programmed into and executed by the processor, to input certain anatomical measurements or information;

receiving, via the user interface, the anatomical measurements or information;

using the processor, according to instructions programmed into and executed by the processor, to derive an eye height measurement from the anatomical measurements or information;

prompting the user, via the user interface, and according to instructions programmed into and executed by the processor, to input certain measurements of the compound bow;

receiving, via the user interface, the measurements of the compound bow;

using the processor, according to instructions programmed into and executed by the processor, to derive (a) a cam-to-arrow distance and (b) a right-to-D-loop distance based on the measurements of the compound bow; and using the processor, according to instructions programmed into and executed by the processor, to calculate the preferred location for the peep sight based on the eye height measurement, the cam-to-arrow distance of the compound bow, and the right-to-D-loop distance of the compound bow;

wherein a vertical reference line extends from (i) a first point of contact between an upper cam and a bowstring of the compound bow, and (ii) a second point of contact between a lower cam and the bowstring of the compound bow, when the compound bow is in a drawn position;

wherein a horizontal reference line is representative of an arrow in the compound bow in the drawn position;

wherein the cam-to-arrow distance is a measurement of a vertical distance between (i) the first point of contact and (ii) the horizontal reference line; and wherein the right-to-D-loop distance is a measurement of a horizontal distance between (i) an intersection of the vertical reference line and the horizontal reference line and (ii) a D-loop of the bowstring in the drawn position.

7. The method as recited in claim 6, wherein the user interface is accessible via a web page.

8. The method as recited in claim 6, wherein as part of the step of prompting the user to input the anatomical measurements or information, instructions are provided via the user interface.

9. The method as recited in claim 6, wherein the step of using the processor to calculate the preferred location for the peep sight includes substeps of:

calculating an angle between the horizontal reference line and a line formed by the bowstring of the compound bow that extends from the upper cam to the D-loop; and calculating the preferred location for the peep sight relative to the D-loop based on the calculated angle and the eye height measurement.

10. A system for determining a preferred location for a peep sight on a compound bow, comprising:

a computer including a processor programmed to execute instructions stored in a memory component to:

prompt a user, via a user interface, to input an eye height measurement, receive, via the user interface, the eye height measurement, prompt the user, via the user interface, to input an identification of the compound bow, receive, via the user interface, the identification of the compound bow, retrieve (a) a cam-to-arrow distance and (b) a right-to-D-loop distance from a database based on the identification of the compound bow, and calculate the preferred location for the peep sight based on the eye height measurement, the cam-to-arrow distance of the compound bow, and the right-to-D-loop distance of the compound bow;

wherein a vertical reference line extends from (i) a first point of contact between an upper cam and a bowstring of the compound bow, and (ii) a second point of contact between a lower cam and the bowstring of the compound bow, when the compound bow is in a drawn position;

wherein a horizontal reference line is representative of an arrow in the compound bow in the drawn position;

wherein the cam-to-arrow distance is a measurement of a vertical distance between (i) the first point of contact and (ii) the horizontal reference line; and wherein the right-to-D-loop distance is a measurement of a horizontal distance between (i) an intersection of the vertical reference line and the horizontal reference line and (ii) a D-loop of the bowstring in the drawn position.

11. The system as recited in claim 10, wherein the user interface is accessible via a web page.

12. A system for determining a preferred location for a peep sight on a compound bow, comprising:

a computer including a processor programmed to execute instructions stored in a memory component to:

prompt a user, via a user interface, to input certain anatomical measurements or information, receive, via the user interface, the anatomical measurements or information, derive an eye height measurement from the anatomical measurements or information;

prompt the user, via the user interface, to input certain measurements of the compound bow, receive, via the user interface, the measurements of the compound bow, derive (a) a cam-to-arrow distance and (b) a right-to-D-loop distance based on the measurements of the compound bow, and calculate the preferred location for the peep sight based on the eye height measurement, the cam-to-arrow distance of the compound bow, and the right-to-D-loop distance of the compound bow;

wherein a vertical reference line extends from (i) a first point of contact between an upper cam and a bowstring of the compound bow, and (ii) a second point of contact between a lower cam and the bowstring of the compound bow, when the compound bow is in a drawn position;

wherein a horizontal reference line is representative of an arrow in the compound bow in the drawn position;

wherein the cam-to-arrow distance is a measurement of a vertical distance between (i) the first point of contact and (ii) the horizontal reference line; and wherein the right-to-D-loop distance is a measurement of a horizontal distance between (i) an intersection of the vertical reference line and the horizontal reference line and (ii) a D-loop of the bowstring in the drawn position.

13. The system as recited in claim 12, wherein the user interface is accessible via a web page.

* * * * *